US005848753A

United States Patent [19]

Wands et al.

[11] Patent Number: 5,848,753

[45] Date of Patent: Dec. 15, 1998

[54] WATERJET ORIFICE ASSEMBLY

[75] Inventors: David C. Wands, Columbus; John L. Scott, Galena, both of Kans.

[73] Assignee: Ingersoll-Rand Company, Woodcliff Lake, N.J.

[21] Appl. No.: 791,027

[22] Filed: Jan. 27, 1997

[51] Int. Cl.[6] ..... B05B 1/00

[52] U.S. Cl. ..... 239/596; 239/600

[58] Field of Search ..... 239/589, 590, 239/591, 596, 600, DIG. 19, 101

[56] References Cited

U.S. PATENT DOCUMENTS

| | | | |
|---|---|---|---|
| 4,074,858 | 2/1978 | Burns et al. | 239/101 X |
| 4,150,794 | 4/1979 | Higgins | 239/596 |
| 4,162,763 | 7/1979 | Higgins | 175/424 X |
| 4,478,368 | 10/1984 | Yie | 239/600 X |
| 4,660,773 | 4/1987 | O'Hanlon | 239/596 |
| 4,836,455 | 6/1989 | Munoz | 239/590.3 |
| 4,852,800 | 8/1989 | Murdock | 239/596 X |
| 4,936,512 | 6/1990 | Tremoulet, Jr. | 239/596 |
| 5,033,681 | 7/1991 | Munoz | 239/DIG. 19 X |
| 5,199,640 | 4/1993 | Ursic | 239/596 X |

*Primary Examiner*—Kenneth Bomberg
*Assistant Examiner*—Steven J. Ganey
*Attorney, Agent, or Firm*—Walter C. Vliet; Leon Nigohosian, Jr.

[57] ABSTRACT

A waterjet orifice assembly is provided with a retaining hat which assembles over a head portion of a nozzle mount to capture a nozzle jewel between the mount and retaining hat so that when assembled in a nozzle assembly between a nozzle tube and a capture nut the nozzle jewel becomes securely held and centrally aligned within the assembly.

5 Claims, 1 Drawing Sheet

WATERJET ORIFICE ASSEMBLY

BACKGROUND OF THE INVENTION

This invention relates generally to fluid jet nozzles and more particularly to an orifice jet nozzle assembly for waterjet cutting machines and the like utilizing high pressure fluids for solid material cutting and similar purposes. As with any energy beam cutting device the alignment of the beam is essential to proper function and accurate cutting. The problem of alignment has previously been addressed by making adjustment devices which align the cutting stream to a required position. The process of alignment takes time and also requires readjustment after several hours of operation. It also involves the possibility of human error in alignment resulting in efficient cutting.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention a waterjet orifice or nozzle assembly is accomplished by providing a waterjet orifice assembly including a mounting base having a through bore and a cylindrical head concentric with and intersecting the through bore; the cylindrical head being further provided with a counter bore of accurately defined depth; an orifice jewel having a depth slightly greater than the depth of the accurately defined counter bore depth inserted in the counter bore; a concentrically deployed retainer having a retainer bore for receiving a defined portion of the cylindrical head therein; and means for retaining the orifice jewel in the counter bore.

The foregoing and other aspects of the present invention will become apparent from the following detailed description of the invention when considered in conjunction with the accompanying drawing figures.

BRIEF DESCRIPTION OF THE DRAWING FIGURES

DETAILED DESCRIPTION

Figure 1:
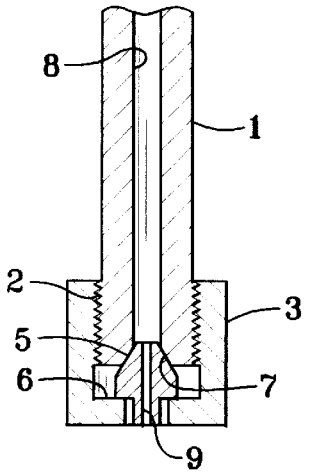
FIG. 1 (PRIOR ART)
FIG. 1 is a cross section of a typical waterjet nozzle assembly.

FIG. 1 shows a mounting assembly capable of accepting an orifice. As shown in FIG. 1, a piece of high pressure tubing, designated by the reference numeral 1, is provided with a threaded end 2, onto which a capture nut 3 is screwed to secure and encapsulate a fixed focus orifice 5 between lands 6 of the captured nut 3 and an alignment and seal taper 7 of the tube 1.

As may be appreciated by one skilled in the art, cutting fluid, for example water under high pressures in the usual range of between 20,000 and 55,000 psi, is supplied to the interior 8 of the tubing 1, and escapes in a focused jet through orifice bore 9. This forms a high pressure concentrated stream of cutting fluid which performs the work of a fluid jet cutting device.

Figure 2:
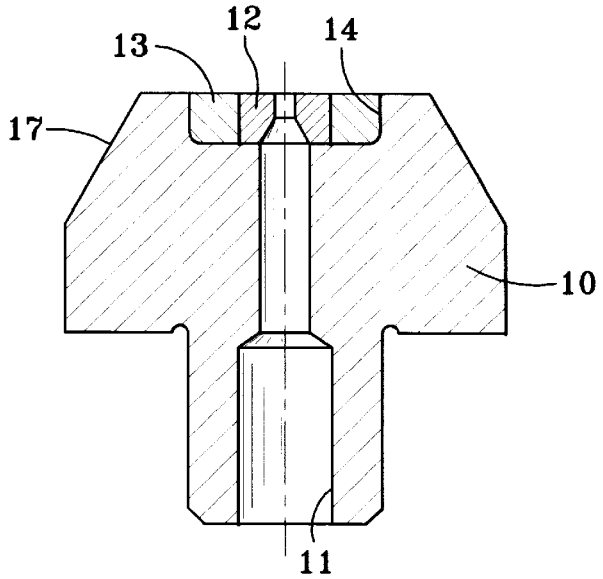
FIG. 2 (PRIOR ART)
FIG. 2 is a cross section of an orifice according to the prior art for installation in the nozzle assembly of FIG. 1.

FIG. 2 shows a nozzle according to the prior art which might be installed in the nozzle fixture formed by tubing 1 and capture nut 3, as shown in FIG. 1. Accordingly, the nozzle is formed of a body portion 10 having an internal bore 11 provided through the center of the body. A complimentary seal taper 17 cooperates with the taper surface 7 of tube 1 to align and seal the orifice body 10 in the assembly. A typical jeweled orifice 12 is shown mounted in a retaining ring 13 which in turn is fit into a counter bore 14 in the body 10.

Although generally acceptable, this embodiment of the prior art fails to provide a positive means of securing the jewel nozzle 12 within the orifice body 10. Although erosion resistant, the hard jewel nozzle 12 is somewhat brittle and difficult to insure precise external dimension. Due to the high operating pressures and sometimes rapid pressure fluctuation accompanying rapid valve operation (required for precise cutting control) the jewel orifices have on occasion become dislodged. The back pressure or vacuum created by rapid valve operation has lifted the jewel out of its mounting location and precipitated a nozzle failure. In addition, erosion or corrosion around the jewel orifice has occurred and further permitted the jewel to both move laterally out of focus or become more easily lost or dislodged from the mounting. According to the present invention a more secure means of mounting the jeweled orifice is accomplished.

Figure 3:
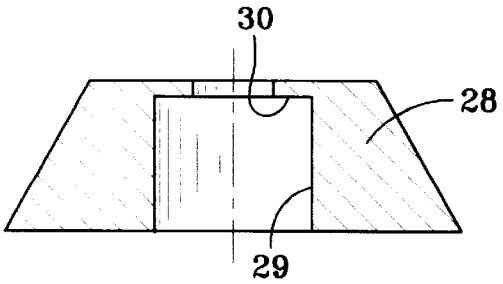
FIG. 3 is a cross section of a new hat portion of a waterjet orifice assembly according to the present invention.
Figure 4:
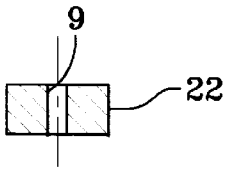
FIG. 4 is a cross section of a jewel orifice for use with the present invention.
Figure 5:
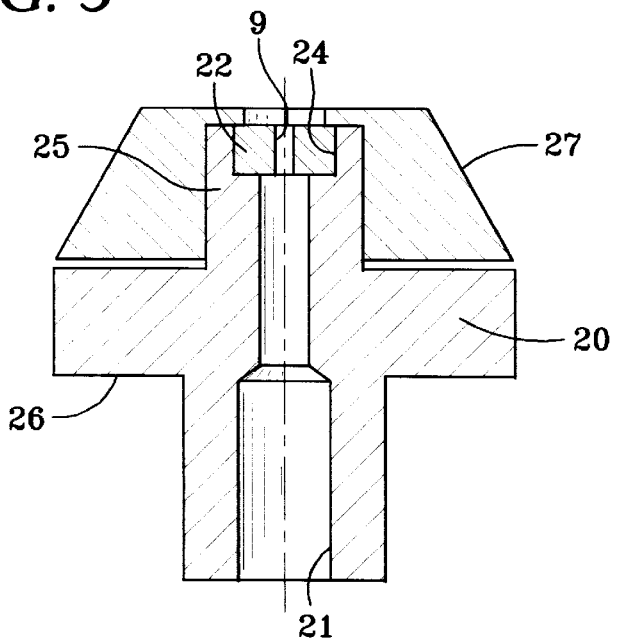
FIG. 5 shows an assembled waterjet orifice assembly according to the present invention shown in cross section.

Referring to FIGS. 3, 4, and 5, an orifice mounting body 20, according to the present invention, is shown. The body 20 is provided with a central through bore 21, a mounting flange 26 for cooperation with the lands 6 of retaining nut 3, and a cylindrical head 25, which is further provided with a counter bore 24 which receives a jewel orifice 22 having an orifice bore 9 which aligns axially along the mounting through bore 21.

The jeweled orifice 22 extends a small amount beyond the end of the head 25, as shown in FIG. 5. A retaining conical hat 28 is provided with a cylindrical bore 29 which cooperates with head 25 by means of an interference fit to secure the hat 28 on the head 25. The conical hat 28 is further provided with an internal flange 30 which presses on and secures the jewel 22 in the bore 24 of the head 25.

The hat 28 is further provided with a conical sealing surface 27 which cooperates with the conical sealing surface 7 of the orifice mount 1. The unique hat design of the present invention permits the jewel 22 to be securely retained in the counter bore 24 with positive retaining pressure developed between the internal retainer flange 30 and the jewel 22. The unique conical hat design also permits selection of materials for both the mount 20 and the hat 28 to insure a good interference fit between the hat 28 and the head 25. Thus, once the hat 28 is pressed fit it will securely hold the orifice jewel 22 in place. In addition, when positioned in the orifice mount 1, the capture nut 3 will further secure the hat 28 to the head 25 thereby eliminating the possibility of the movement or escape of the orifice jewel 22.

According to the present invention, it has been found that suitable materials for the jewel orifice are diamond or sapphire or other erosion resistant material or the like. The mount 20 and hat 28 may be manufactured from materials such as stainless steel or the like having high degrees of corrosion resistance and adequate ductility to assure a good interference fit.

Having described our invention in terms of a preferred embodiment, we do not wish to be limited in the scope of our invention except as claimed.

What is claimed is:

1. A waterjet orifice assembly comprising:

a mounting base having a through bore and a cylindrical head concentric with and intersecting said through bore;

said cylindrical head being further provided with a counter bore of accurately defined depth;

an orifice jewel having a depth slightly greater than the depth of the accurately defined counter bore depth inserted in said counter bore;

a concentrically deployed retainer having a retainer bore for receiving and slidingly engaging a defined portion of said cylindrical head therein by an interference fit;

means on said retainer for retaining said orifice jewel in said counter bore; and stop means on said retainer for positioning said orifice jewel at a predetermined position within a waterjet nozzle assembly.

2. A waterjet orifice assembly according to claim 1 wherein:

said mounting base is further provided with a concentrically disposed mounting flange.

3. A waterjet orifice assembly according to claim 1 wherein:

said orifice jewel is further provided with an orifice bore for alignment with said through bore.

4. A waterjet orifice assembly according to claim 1 wherein:

said stop means is a conical exterior for concentric alignment with said waterjet nozzle assembly.

5. A waterjet orifice assembly according to claim 4 wherein:

said retainer is provided with a reduced diameter portion of said retainer bore forming a contacting flange as means for retaining said orifice jewel.

* * * * *